US007654499B2

(12) United States Patent
Lane

(10) Patent No.: US 7,654,499 B2
(45) Date of Patent: Feb. 2, 2010

(54) BOOKSTAND THAT FOLDS THIN ENOUGH TO SERVE AS A BOOKMARK

(76) Inventor: Ronald S. Lane, 2 Kakita La., Spring Valley, NY (US) 10977

( * ) Notice: Subject to any disclaimer, the term of this patent is extended or adjusted under 35 U.S.C. 154(b) by 0 days.

(21) Appl. No.: 10/605,663

(22) Filed: Oct. 16, 2003

(65) Prior Publication Data

US 2004/0113037 A1 Jun. 17, 2004

Related U.S. Application Data

(60) Provisional application No. 60/419,740, filed on Oct. 18, 2002.

(51) Int. Cl.
*A47B 97/04* (2006.01)

(52) U.S. Cl. ..... 248/459; 248/460

(58) Field of Classification Search ..... 248/459, 248/460, 454, 455, 456, 457
See application file for complete search history.

(56) References Cited

U.S. PATENT DOCUMENTS 3,785,605 A * 1/1974 Parekh ..... 248/455
4,739,960 A * 4/1988 Adler ..... 248/453

* cited by examiner

*Primary Examiner*—Gwendolyn Baxter

(57) ABSTRACT

A bookstand made up of a thin material that when in its folded out position receives a book so that the back of the book is tilted up to make its pages more easily viewed by the reader, and that can be folded flat enough to be placed inside the pages of the book so that it can be used as a bookmark.

1 Claim, 9 Drawing Sheets

Diagram 1
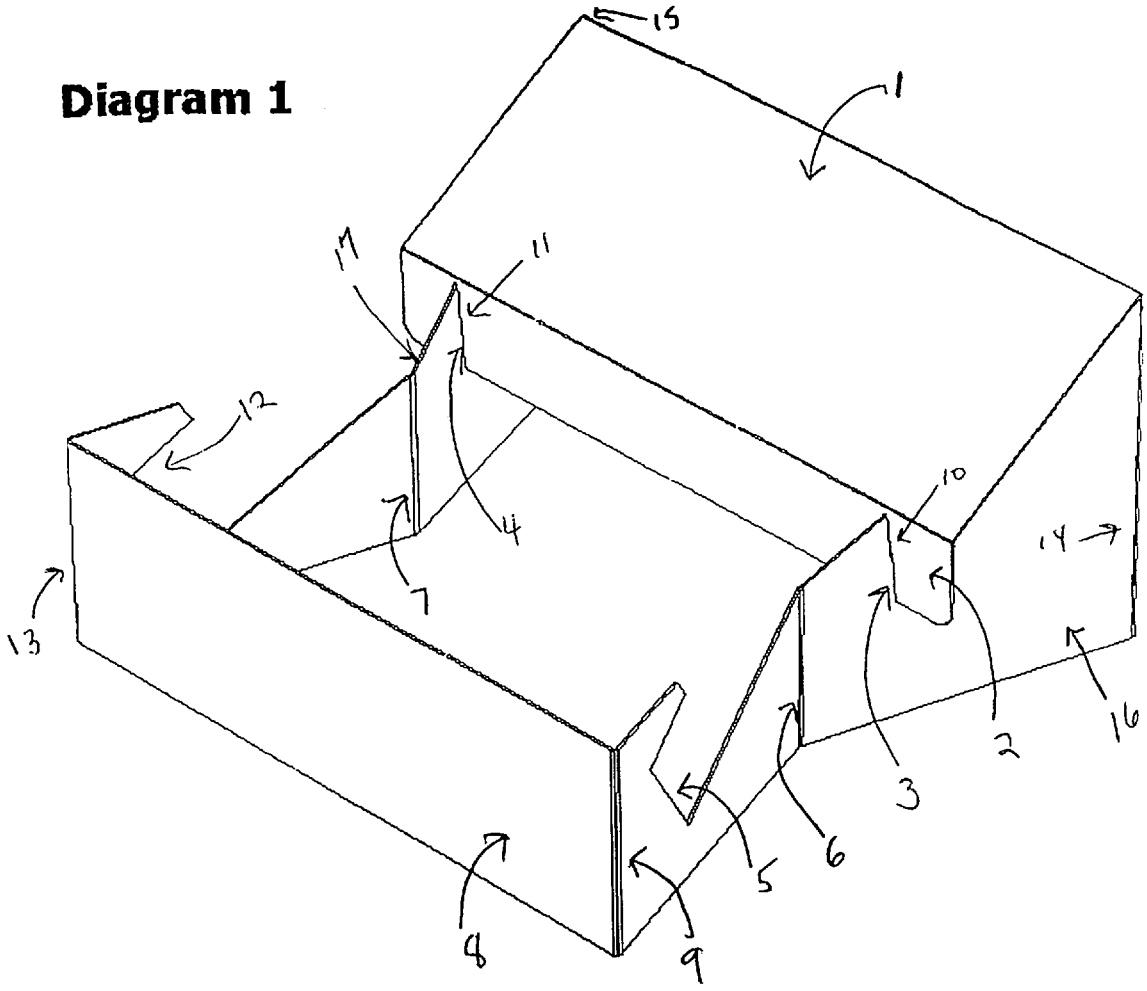

DIAGRAM 2
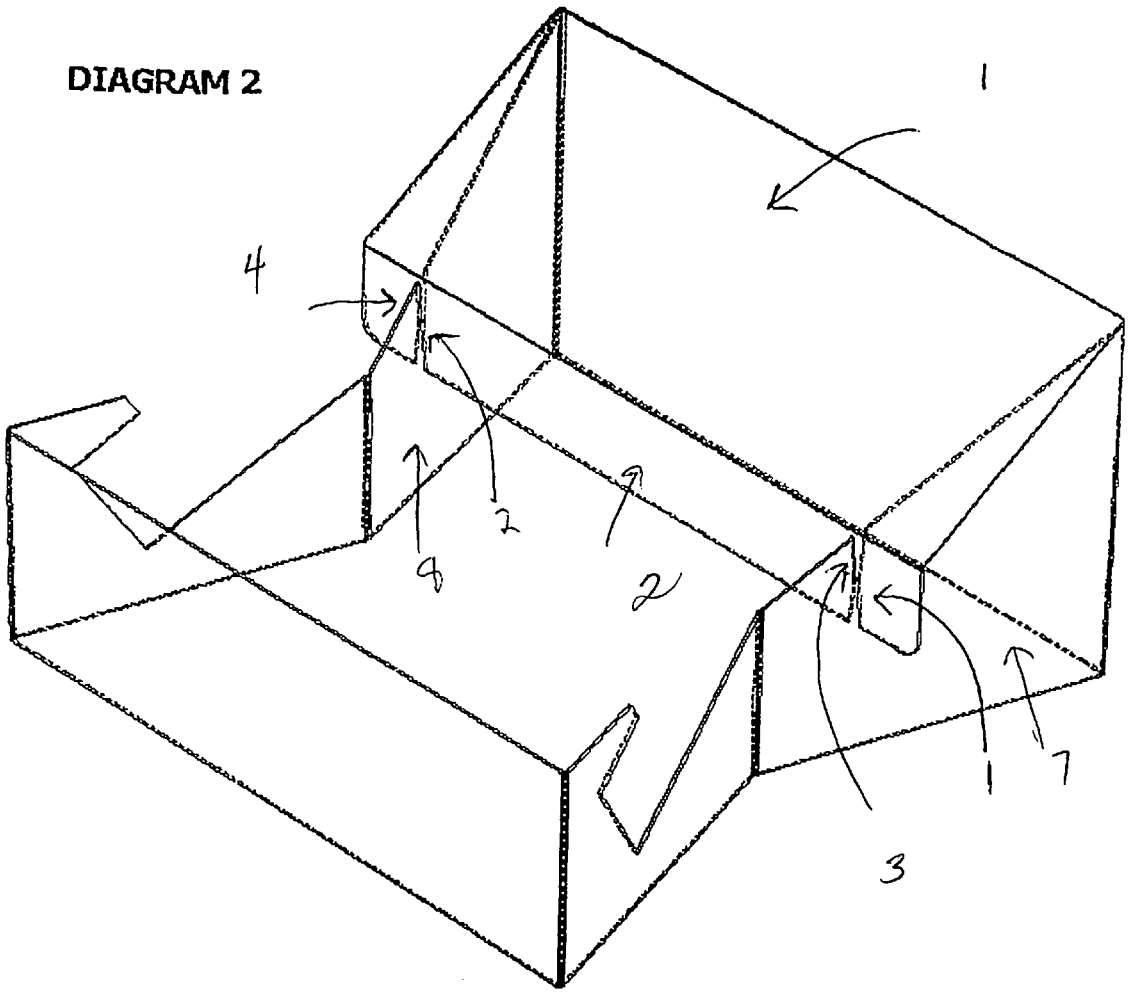

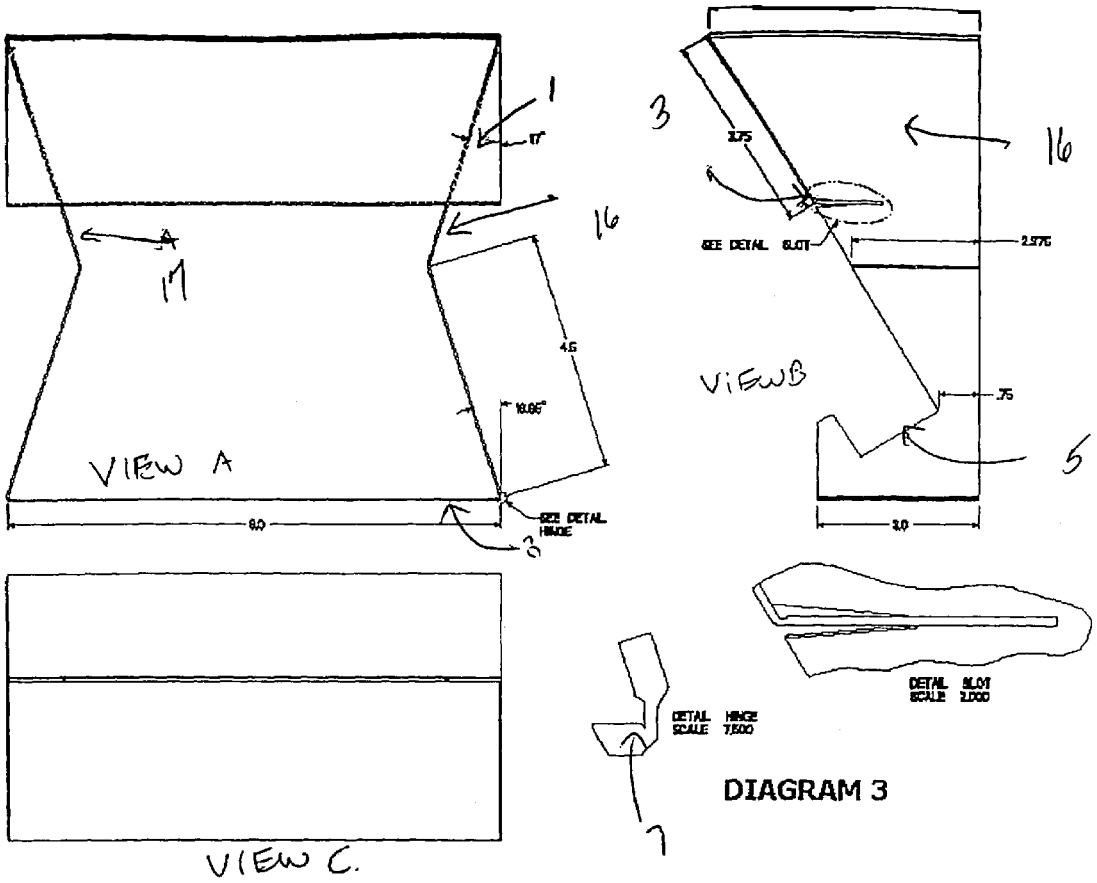
DIAGRAM 3

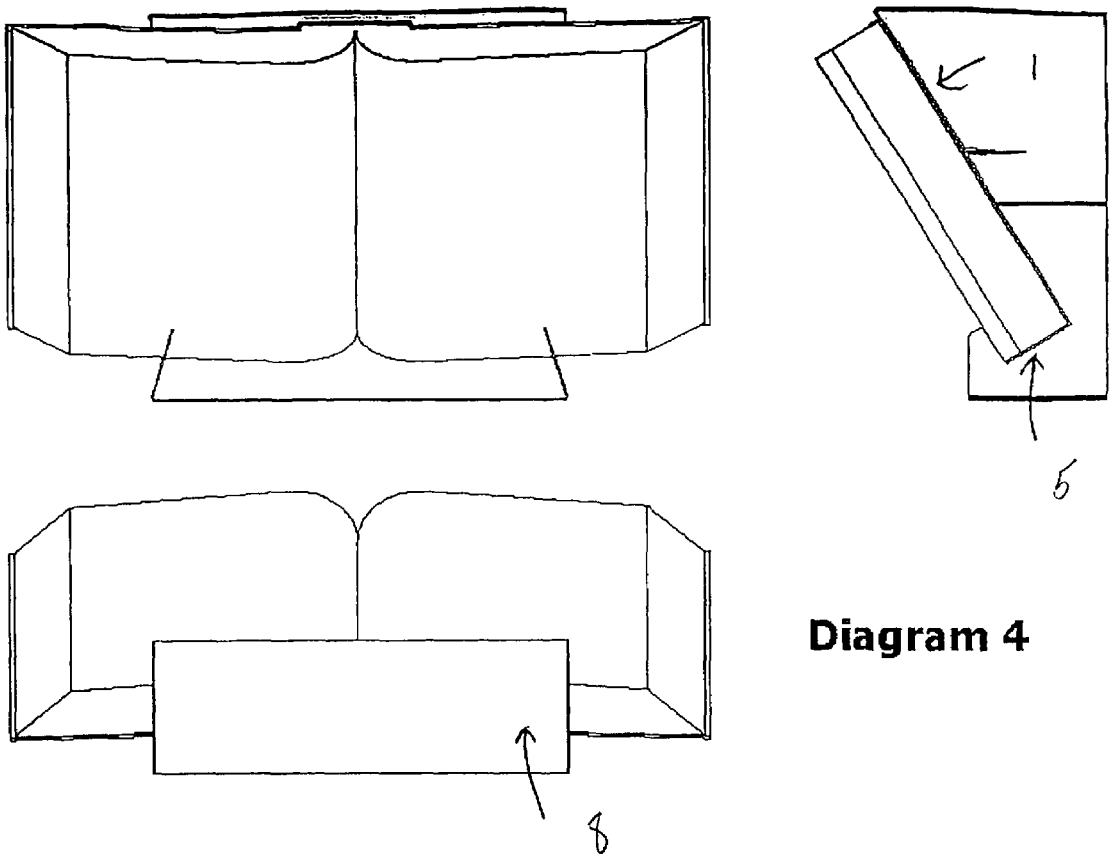
Diagram 4

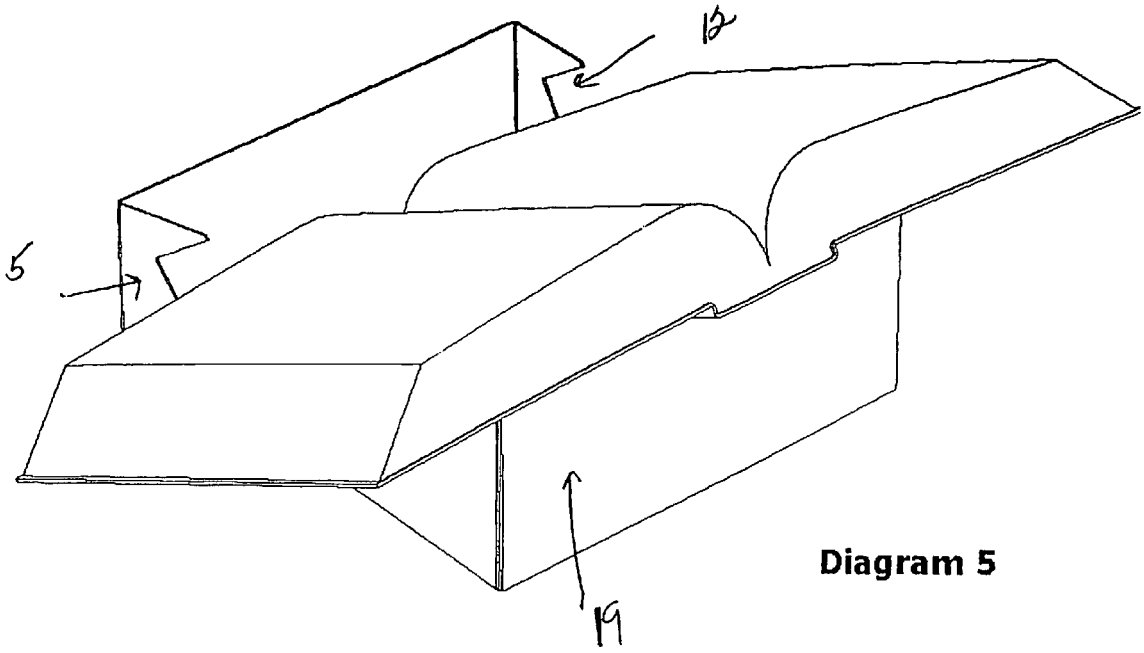
Diagram 5

Diagram 6
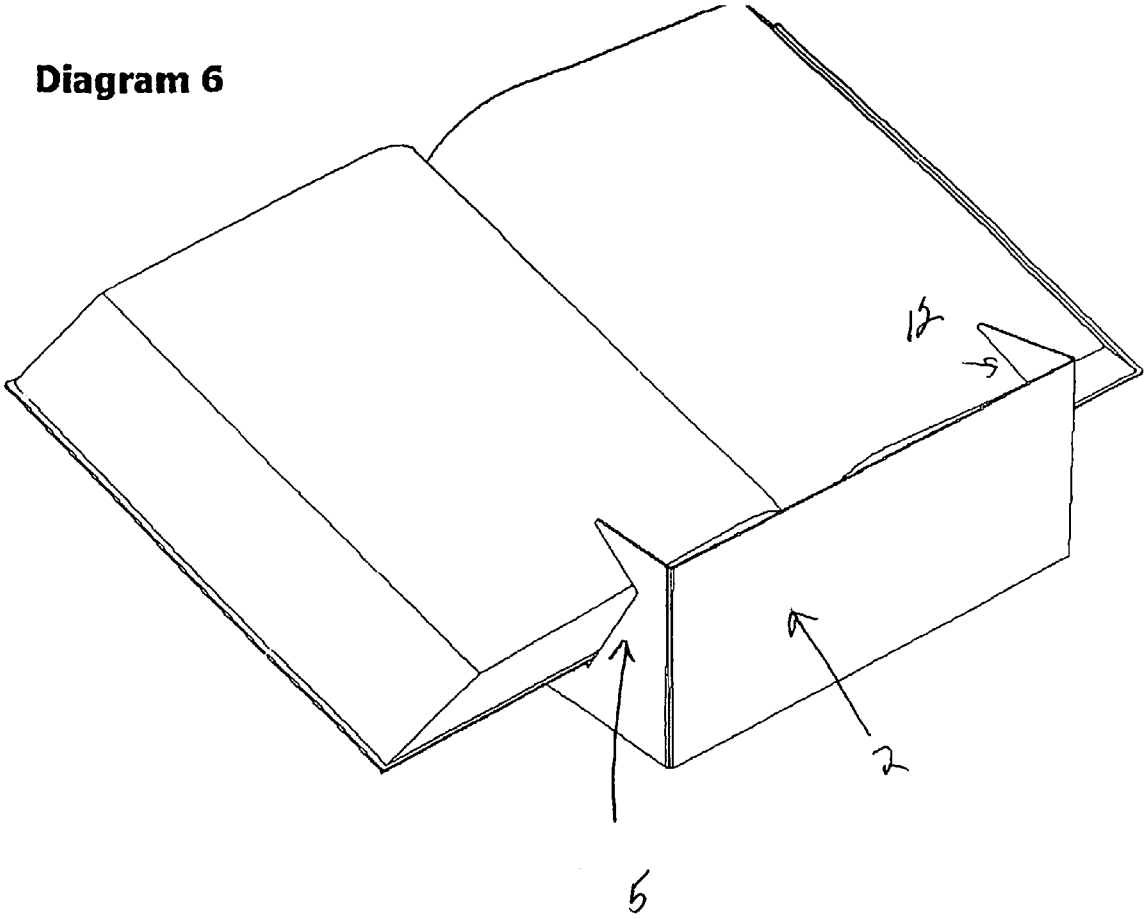

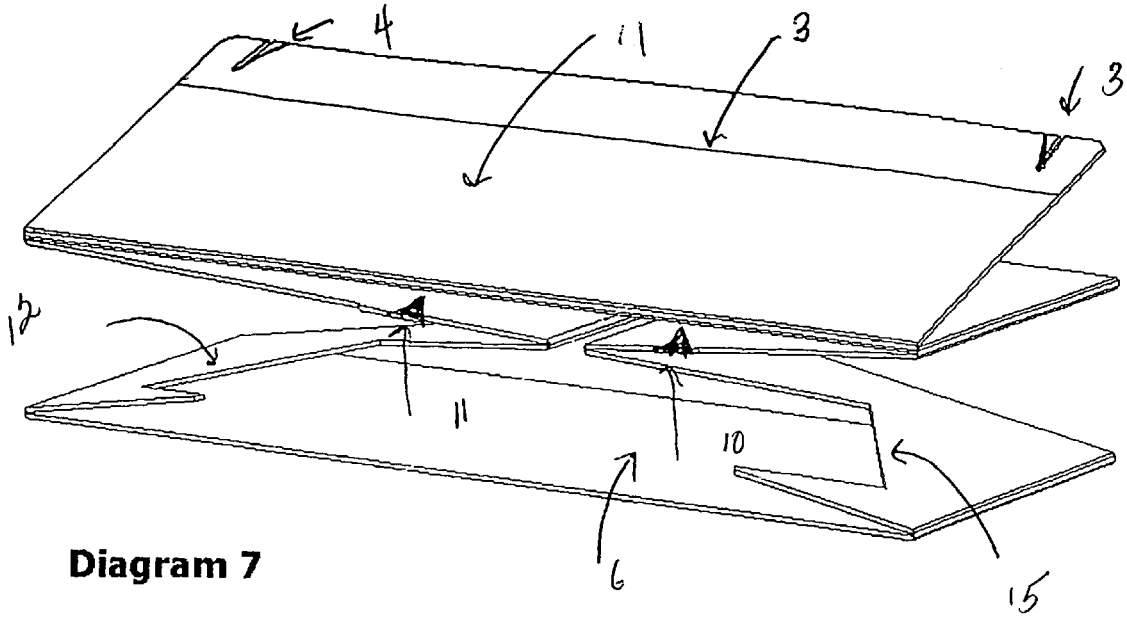
Diagram 7

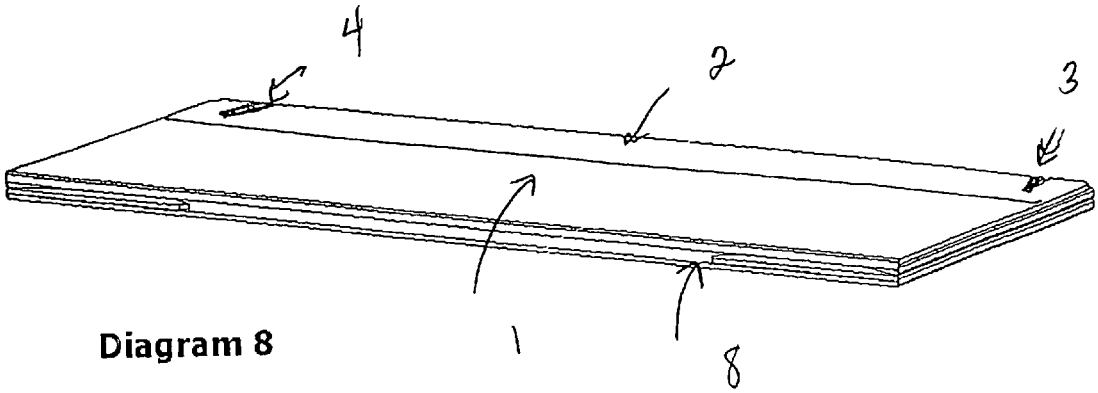
Diagram 8

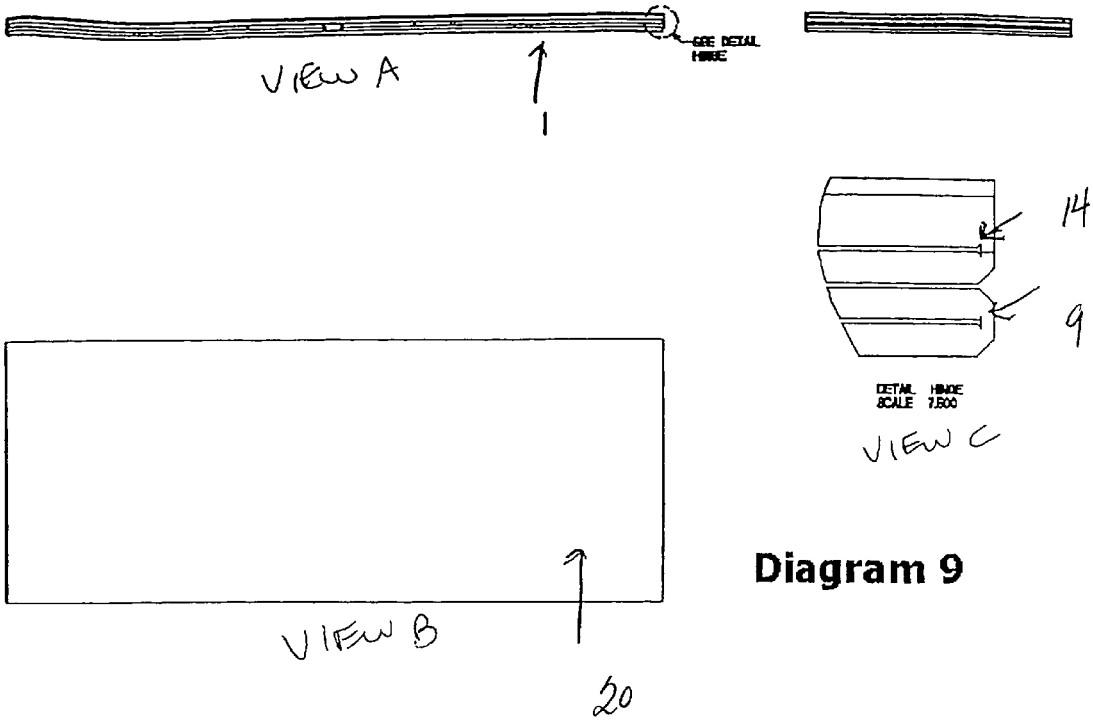
Diagram 9

BOOKSTAND THAT FOLDS THIN ENOUGH TO SERVE AS A BOOKMARK

This patent application is a continuation of the provisional patent 60/419,740 filed on Oct. 18, 2002, by Ronald S. Lane. The Express Mail Label Number was EU842758102US

SUMMARY OF INVENTION

The invention which we call a "thinstand™"—serves the basic purpose of most bookstands, e.g. tilting the back of the book up towards the reader so that its pages are viewed more directly and easily. The major improvement of the invention is that it can fold flat when not serving as a bookstand—flat enough to be stored in the book when not being used, so it can serve the additional purpose of being used as a bookmark.

DETAILED DESCRIPTION

If you do a patent search for 'bookstands', you will find hundreds of patented inventions. The main purpose of a bookstand is to overcome the problem that when you read a book that is lying on a desk, it is not fully facing you but angled away from you, reducing your vision of the book. Most bookstands lift the back of the book so that the pages of book face the reader more directly. Since a bookstand needs to support the weight of the book, it is often made of a substantial material, such as metal or wood. The disadvantage of such bookstands is that they are bulky and inconvenient to carry around. It becomes an additional item to carry around.

Our invention—which we call a 'thinstand™'—serves the basic purpose of most bookstands, e.g. tilting the back of the book towards the reader. The major difference with our invention is that it can fold flat when not serving as a bookstand. This has some important advantages:

- It is thin, light, and very convenient to carry around, because it can be put flat into the pages of the book itself.
- When it is put into the book, it can be placed at the page the reader is up to, thereby also serving as a bookmark.
- It can be made very inexpensively from such materials such as thin plastic or cardboard.
- It has a large flat surface area that faces the reader, making it an ideal 'advertising specialties item', especially since it can be made so inexpensively.

For these reasons, our invention is novel, inventive, and very useful.

We will now describe the invention by referring to a series of 11 drawings. Some of the drawings reflect an older embodiment of the invention, and some a newer embodiment. The difference lies in how the back plane surface that the back of the book rests on locks into place into the legs that support it that back plane.

Diagram 1 shows the stand fully unfolded ready to receive a book. A flap 1 that is folded down and it has a lip 2 that is 'locked' into place into cutouts 3 and 4. This keeps the stand from 'unfolding' itself, and bears the weight of the book. This flap includes a 'lip' 2 that has two notches 10 and 11 that fits into corresponding notches 3 and 4 in the upper part of each of the legs. The legs have creases 6, 7, 9, 13, 14, and 15 that allow the stand to fold flat. The body of the stand also has cutouts 5 and 12 into which the front of the book slides and is held, keeping the pages from turning. The front surface of the bookstand is 8, which can be cut smaller.

Diagram 2 is very similar to diagram 1, but is a 'see-through' version where you can see the lines that are behind the surfaces in diagram 1. Specifically it shows how the flap 5 that supports the book has a lip 2 that contains two V shaped cutouts 10 and 11, that fit neatly into cutouts 3 and 4 that are in the legs 16 and 17. It is clear how cutouts 10 and 11 fit into 3 and 4 to give the bookstand sturdiness and to support the weight of the book.

Diagram 3 shows three views of the stand. The upper left View A shows the top view, and shows flap 1 sitting on legs 16 and 17. The upper right View B shows the side view. The back side surface is 6, the lip of the flap folds into the cutout 3 to give rigidity to the bookstand, and 6 is the cutout into which the pages of the book are placed to keep the pages from turning. The bottom View C shows the fully frontal view, which has a large surface to put 'ad specialty' imprinting. This view also shows 7 which shows how the plastic bends.

Diagram 4 shows the stand with a book resting on it from three additional angles. The upper left view shows it from above, the upper right shows it from the side, and the bottom drawing shows it from in front. 8 shows the front of the bookstand (which can be smaller), 5 shows the cutout that receives the pages of the book, and 1 shows the flap upon which the back of the book rests.

Diagram 5 shows the stand with a book resting on it from the viewpoint of someone looking from behind the stand, with the person facing the other person who would be reading the book. 19 shows the back of the bookstand, and 5 and 12 show the cutouts that receive the pages of the book.

Diagram 6 shows the stand with the book on it. 5 and 12 show the cutouts that receive the left and right pages of the book respectively, and 8 shows the front of the bookstand that can be made smaller.

Diagram 7 shows the stand in the act of being folded. 3 and 4 are the cutouts of flap 9 that fit into cutouts 10 and 11. 3 shows where flap 1 folds. Cutouts 5 and 12 are where the pages of the book are received when the stand is in its unfolded position. 8 is the front.

Diagram 8 shows the stand in its fully folded position, and shows how tidy and thin it is in this position. 3 and 4 are the cutouts in flap 1 and lip 2. The front of stand is 8. When the stand is made of a thin, sturdy plastic, the stand can even be thinner than it is pictured here, and can serve the purpose of being used as a bookmark.

Diagram 9 shows the stand in its fully folded position. View A shows how flat the bookstand is, with all the layers stacked on top of each other as 1. View B shows the surface 4 of the stand in its folded position. View C shows the detail of the hinges 9 and 14 that permits the folding. In plastic this is often accomplished by using what is called a 'living hinge', where a thinner section of the plastic permits repeated bending without causing the plastic to break.

The embodiment of the invention is for illustration purposes, and should not be construed As the only embodiment of the invention possible.

The invention claimed is:

1. A one-piece collapsible stand which is foldable between an erected operative configuration for supporting a book in an inclined position and a collapsed inoperative configuration wherein the stand is a flat thin bookmark; the stand comprises a front plate, first and second side legs and a back plate;

a. said front plate having a front bottom side, front top side, front left side and front right side;

b. said back plate having a back bottom side, back top side, back left side and back right side;

c. each of the first and second side legs include a first portion and an adjacent second portion such that the first portion is foldably joined to said second portion by a living hinge there between said first and second portions;

d. said front left and right sides of said front plate are foldably attached to said first portion of said first and second side legs, respectively; said back left and right sides of said back plate are foldably attached to said second portion of said first and second side legs, respectively;

e. a top edge of said second portion of said first and second side legs, respectively, include a notch engaging a respective notch of a first flap that is foldably attached to a second flap which is foldably attached to said back top side of said back plate in said erected operative configuration;

f. a top edge of the first portion of said first and second side legs includes a J-shaped cutout, respectively, adapted to receive and retain said book therein in said erected operative configuration; and g. in said collapsed inoperative configuration, the book stand is used as said thin bookmark such that said lip is parallel to said flap; said first portion of said first and second legs are parallel to said back plate; said second portions of said first and second legs are parallel to said first portions; and said front plate is parallel to said second portions of said first and second legs.

* * * * *